US011272828B2

(12) United States Patent
Ryan

(10) Patent No.: US 11,272,828 B2
(45) Date of Patent: Mar. 15, 2022

(54) WASH RACK FOR A DISHWASHER AND METHOD OF MAKING A WASH RACK

(71) Applicant: Haier US Appliance Solutions, Inc., Wilmington, DE (US)

(72) Inventor: Justin Daniel Ryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/928,556

(22) Filed: Jul. 14, 2020

(65) Prior Publication Data

US 2022/0015603 A1 Jan. 20, 2022

(51) Int. Cl.
*A47L 15/50* (2006.01)
*A47L 15/14* (2006.01)

(52) U.S. Cl.
CPC ..... *A47L 15/50* (2013.01); *A47L 15/14* (2013.01)

(58) Field of Classification Search
CPC ..... A47L 15/14; A47L 15/42; A47L 15/50; A47L 15/501; A47L 15/502; A47L 15/503; A47L 15/505
USPC ..... 211/41.1–41.9
See application file for complete search history.

(56) References Cited

U.S. PATENT DOCUMENTS 645,344 A * 3/1900 White ..... B65D 7/20 220/492
933,517 A * 9/1909 Worcester ..... A47B 87/0261 211/126.11
1,408,026 A * 2/1922 Ochiltree ..... B42F 7/10 220/62
1,445,259 A * 2/1923 Wiselogel ..... B65D 7/20 220/491
1,463,098 A * 7/1923 Snyder ..... B65D 25/24 220/630
1,660,410 A * 2/1928 Beckman ..... B65D 7/065 220/486
1,782,794 A * 11/1930 Sadwith ..... E04C 2/384 52/792.1
2,141,400 A * 12/1938 Mack ..... B21D 31/04 52/670
2,189,611 A * 2/1940 Mack ..... B21D 31/04 34/238
2,502,781 A * 4/1950 Erickson ..... B60R 9/04 220/491
2,825,481 A * 3/1958 Glenny ..... B65D 7/20 220/492

(Continued)

FOREIGN PATENT DOCUMENTS

AU 2016286937 A1 1/2017

*Primary Examiner* — Patrick D Hawn
(74) *Attorney, Agent, or Firm* — Dority & Manning, P.A.

(57) ABSTRACT

A dishwasher includes a tub defining a wash chamber, a spray body positioned within the wash chamber of the tub, and a wash rack positioned within the wash chamber of the tub above the spray body along the vertical direction. The wash rack includes an expanded metal basket comprising a base panel and a plurality of side panels extending upwardly from the base panel, the expanded metal basket defining a basket volume, the base panel comprising a plurality of strands, and a plurality of integral tines extending from the base panel, wherein each of the plurality of integral tines is bent at a junction of the plurality of strands. Methods of making and using the wash rack are also provided.

18 Claims, 5 Drawing Sheets

(56) References Cited

U.S. PATENT DOCUMENTS 2,885,087 A * 5/1959 Bliss ..... A47L 19/04 211/41.4
3,042,351 A * 7/1962 Du Bois ..... H02G 3/0437 248/49
3,224,736 A * 12/1965 Musgrave ..... E04H 17/06 256/8
3,289,314 A * 12/1966 Porta ..... F26B 5/06 34/92
3,289,854 A * 12/1966 Kauffman ..... A47L 15/505 211/41.9
3,394,819 A * 7/1968 Saville ..... C25D 17/06 211/41.1
3,439,667 A * 4/1969 Stone ..... F24B 1/193 126/540
3,669,092 A * 6/1972 Bolster ..... F24B 1/193 126/541
4,339,048 A * 7/1982 McMillen ..... B65F 1/141 211/85.19
5,201,826 A * 4/1993 Zimmermann ..... A47L 15/505 211/41.9
5,351,837 A * 10/1994 Smith ..... A47L 15/503 211/41.8
6,571,965 B1 * 6/2003 Beck ..... A47L 15/503 211/41.8
7,270,245 B2 * 9/2007 Cheng ..... A47B 55/02 211/126.15
8,118,179 B2 * 2/2012 Smith ..... A47J 47/16 211/41.5
8,141,737 B1 * 3/2012 Tsai ..... B65D 7/14 220/485
8,267,261 B2 * 9/2012 Vanderhoek ..... A01G 9/143 211/150
8,528,471 B2 * 9/2013 Nelson ..... A47J 43/24 99/495
8,579,120 B2 * 11/2013 Classen ..... A47L 15/503 211/41.8
8,985,374 B2 * 3/2015 Tsai ..... B65D 7/20 220/485
9,119,524 B2 * 9/2015 Renz ..... A47L 15/503
9,149,112 B2 * 10/2015 Yeh ..... A47B 47/024
9,586,718 B2 * 3/2017 Tsai ..... B65D 7/14
9,629,462 B2 * 4/2017 Fu ..... A47B 88/95
9,924,851 B2 * 3/2018 Kulkarni ..... A47L 15/505
10,232,412 B2 * 3/2019 Milligan ..... B08B 3/04
2004/0075558 A1 4/2004 McGrath
2004/0079713 A1 * 4/2004 Wendt ..... A47L 15/502 211/41.8
2005/0000554 A1 * 1/2005 Curran ..... A47L 15/505 134/135
2005/0109378 A1 * 5/2005 Landsiedel ..... A47L 15/14 134/135
2005/0133469 A1 * 6/2005 Mersch ..... A47L 15/504 211/41.8
2005/0178412 A1 * 8/2005 Koch ..... A47L 15/505 134/135
2006/0013694 A1 * 1/2006 Eubank ..... F04D 29/703 416/247 R
2007/0125725 A1 * 6/2007 Kemper ..... A47L 19/04 211/41.3
2007/0277855 A1 * 12/2007 DiPanni ..... A47J 43/24 134/25.3
2008/0093314 A1 * 4/2008 Classen ..... A47L 15/502 211/41.8
2012/0006769 A1 * 1/2012 Kaps ..... A47L 15/501 211/41.8
2016/0096971 A1 * 4/2016 Papke ..... C09D 175/06 428/412
2020/0214270 A1 * 7/2020 Cavazos ..... A01K 39/0113
2021/0129202 A1 * 5/2021 Kirchknopf ..... B60H 1/3407

* cited by examiner

WASH RACK FOR A DISHWASHER AND METHOD OF MAKING A WASH RACK

FIELD OF THE INVENTION

The present subject matter relates generally to dishwasher appliances, and more particularly to wash racks removably received within dishwasher appliances and methods of forming wash racks.

BACKGROUND OF THE INVENTION

Dishwasher appliances generally include at least one dish rack for holding dishes, such as plates, bowls, utensils, glassware, pots, pans, and the like. Certain dish racks are constructed of a plurality of interconnected wires that form a basket. Tines are mounted within the basket for supporting the various dishes. The wires and tines are commonly made of metal, such as steel, covered with a protective coating, such as nylon or polyvinyl chloride (PVC). The protective coating provides a physical barrier over the wires and tines to protect the metal from exposure to water and fluid additives, such as detergents and rinse aids, within the dishwasher. As a result, the protective coating assists with preventing corrosion of the dish rack.

Conventional construction of dish racks with separate wires that form the basket and tines has drawbacks. For example, each of the interconnected wires that form the basket is supplied from large coils of wire, which occupy space inside of a manufacturing facility or warehouse. Multiple machines are then required to measure, cut, and form the separate wires into useable pieces. Additionally, machines are required to form and cut separate tines which will be attached to the formed basket (e.g., by welding), such machines requiring frequent and cumbersome maintenance and upkeep. Finally, a large team of material handlers is required to maneuver the basket wires and tine wires around the manufacturing facility or warehouse and perform a multitude of welds to assemble the prefabricated baskets and tines together. In one example, a multistage welding process includes laying out the wires to be interconnected, welding the basket together, welding the tines to the basket, and checking for missed welds or deficiencies.

Accordingly, a wash rack that is formed from a single moldable piece in a limited number of steps would be useful. Additionally, a method of forming a wash rack for dishwasher appliances to obviate one or more of the above mentioned deficiencies would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance is disclosed. The dishwasher appliance may define a vertical direction, a lateral direction, and a transverse direction that are mutually perpendicular. The dishwasher may further comprise a tub defining a wash chamber, a spray body positioned within the wash chamber of the tub, and a wash rack positioned within the wash chamber of the tub above the spray body along the vertical direction. The wash rack may comprise an expanded metal basket comprising a base panel and a plurality of side panels extending upwardly from the base panel, the expanded metal basket defining a basket volume, the base panel comprising a plurality of strands; and a plurality of integral tines extending from the base panel, wherein each of the plurality of integral tines is bent at a junction of the plurality of strands.

In another exemplary aspect of the present disclosure, a method of forming a dishwasher rack is disclosed. The method may comprise generating a sheet of expanded metal having a plurality of strands, rolling the sheet of expanded metal through a rolling mill, removing a predefined region from each corner of a plurality of corners of the sheet of expanded metal to form a plurality of extensions extending from a base panel of the sheet of expanded metal, clipping a single end of a strand of the plurality of strands, the clipped end being opposite of an unclipped end, bending the clipped strand upright as a tine with respect to the unclipped end, bending each extension of the plurality of extensions upright with respect to the base panel, and joining adjacent extensions of the plurality of extensions to define a basket volume together with the base panel of the sheet of expanded metal These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
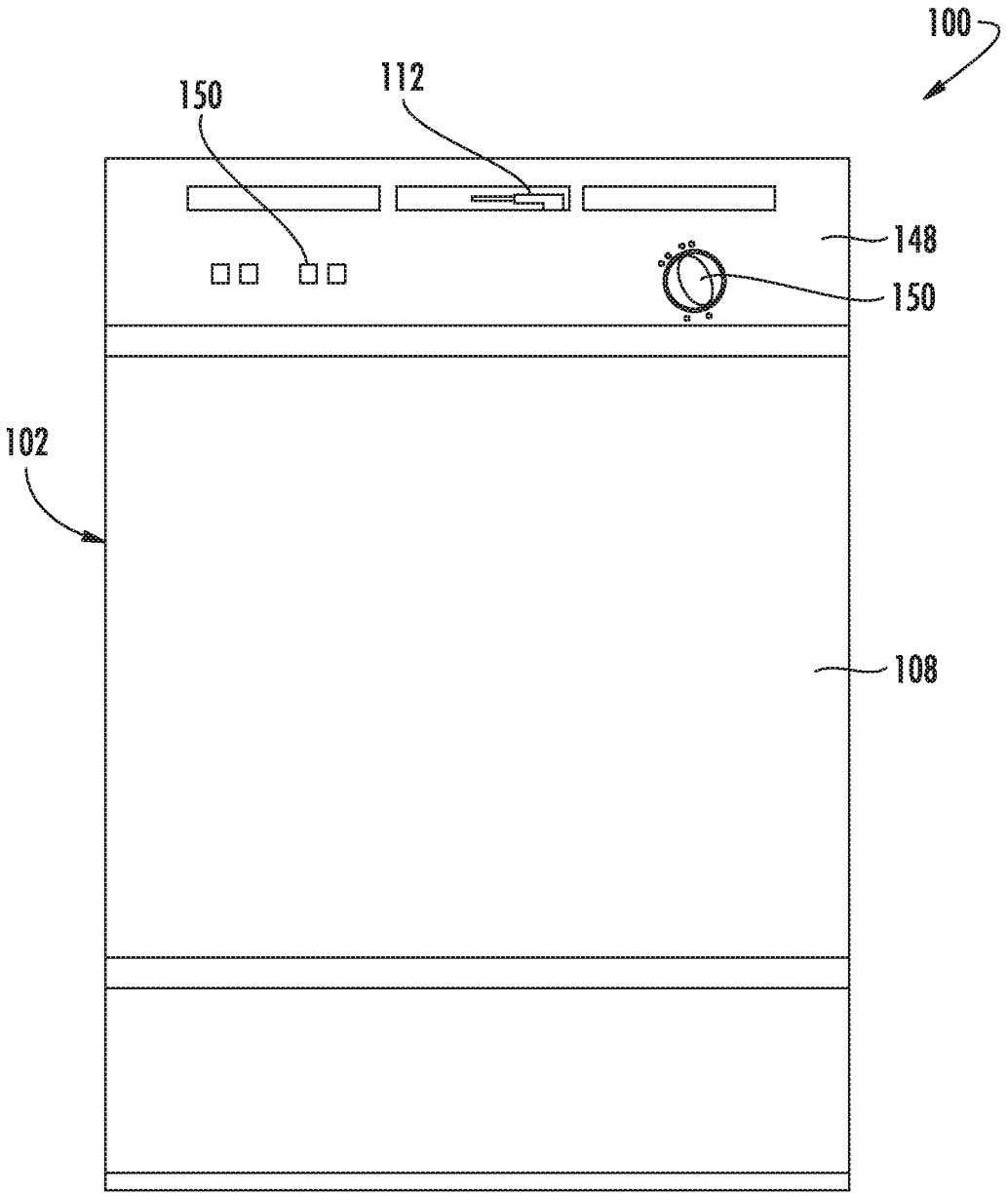
FIG. 1 provides a front view of a dishwasher appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
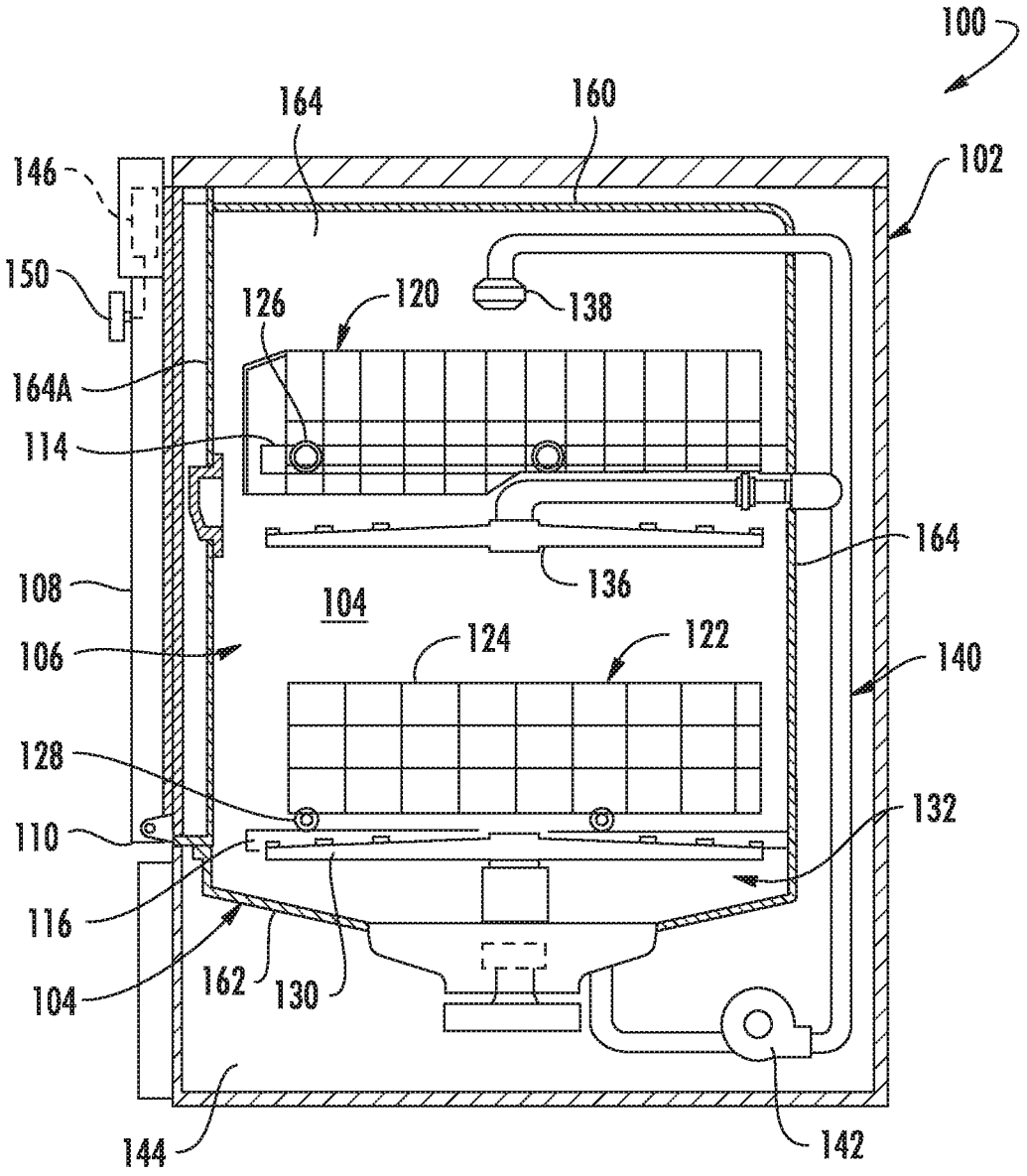
FIG. 2 provides a section side view of the exemplary dishwasher appliance of FIG. 1.

Referring now to the drawings, FIGS. 1 and 2 illustrate an exemplary embodiment of a dishwasher appliance 100 that may be configured in accordance with aspects of the present disclosure. As shown in the illustrated exemplary embodiment, dishwasher appliance 100 may include a cabinet 102 having a tub 104 therein defining a wash chamber 106. Tub 104 may generally include a front opening (not shown) and a door 108 hinged at its bottom 110 for movement between a normally closed vertical position (shown in FIGS. 1 and 2), wherein wash chamber 106 is sealed shut for washing operation, and a horizontal open position (shown in FIG. 3) for loading and unloading of articles from dishwasher appliance 100. As shown in FIG. 1, a latch 112 may be used to lock and unlock door 108 for access to wash chamber 106.

Figure 3:
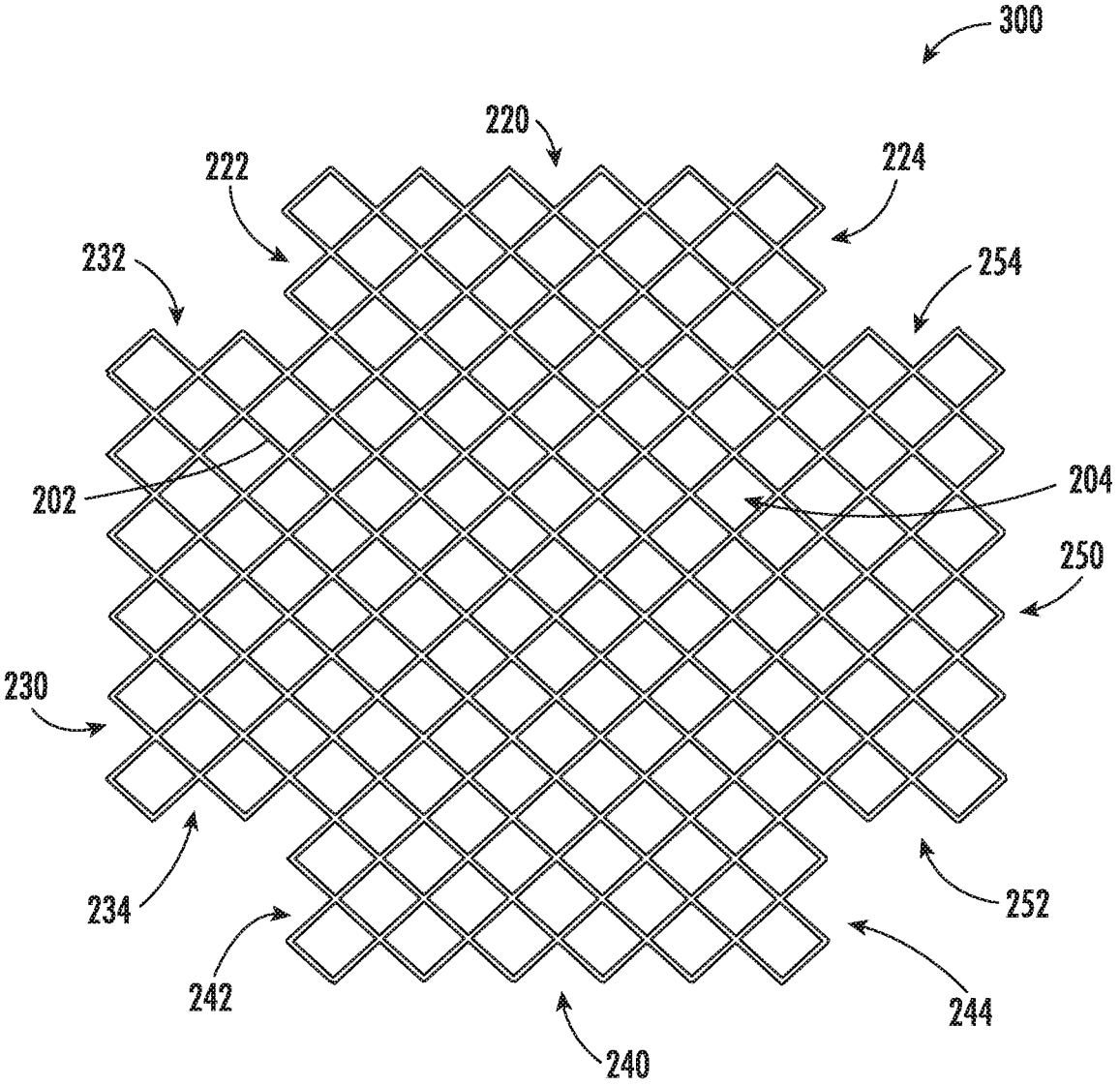
FIG. 3 provides a plan view of an expanded metal blank of a wash rack according to an exemplary dishwasher appliance.

As is understood, tub 104 may generally have a rectangular cross-section defined by various wall panels or walls. For example, as shown in FIG. 2, tub 104 may include a top wall 160 and a bottom wall 162 spaced apart from one another along a vertical direction V of dishwasher appliance 100. Additionally, tub 104 may include a plurality of sidewalls 164 (e.g., four sidewalls) extending between the top and bottom walls 160 and 162. As shown in FIG. 3, a front sidewall 164A of tub 104 may generally define the inner wall or inner surface of door 108. It should be appreciated that tub 104 may generally be formed from any suitable material. However, in several embodiments, tub 104 may be formed from a ferritic material, such as stainless steel, or a polymeric material.

As particularly shown in FIG. 2, upper and lower guide rails 114, 116 may be mounted on opposing side walls 164 of tub 104 and may be configured to accommodate roller-equipped rack assemblies 120 and 122. For example, each of rack assemblies 120 and 122 may be fabricated into lattice structures including a plurality of elongated members 124 (for clarity of illustration, not all elongated members making up assemblies 120 and 122 are shown in FIG. 2). For another example, each rack 120 and 122 may be fabricated as a single piece. Additionally, each rack 120 and 122 may be adapted for movement between an extended loading position (not shown) in which the rack is substantially positioned outside wash chamber 106, and a retracted position (shown in FIGS. 1 and 2) in which rack is located inside wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by racks 120 and 122.

Additionally, dishwasher appliance 100 may also include a lower spray-arm assembly 130 that is configured to be rotatably mounted within a lower region 132 of wash chamber 106 directly above bottom wall 162 of tub 104 so as to rotate in relatively close proximity to rack assembly 122. As shown in FIG. 2, a mid-level spray-arm assembly 136 may be located in an upper region of wash chamber 106, such as by being located in close proximity to upper rack 120. Moreover, an upper spray assembly 138 may be located above upper rack 120.

As is generally understood, lower and mid-level spray-arm assemblies 130 and 136 and upper spray assembly 138 may generally form part of a fluid circulation system 140 for circulating fluid (e.g., water and dishwasher fluid) within the tub 104. As shown in FIG. 2, fluid circulation system 140 may also include a pump 142 located in a machinery compartment 144 below bottom wall 162 of tub 104, as is generally recognized in the art. Moreover, each spray-arm assembly 130 and 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of lower spray-arm assembly 130 provides coverage of dishes and other dishwasher contents with a washing spray.

Dishwasher appliance 100 may be further equipped with a controller 146 configured to regulate operation of dishwasher appliance 100. Controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 146 may be positioned in a variety of locations throughout dishwasher appliance 100. In the illustrated embodiment, controller 146 is located within a control panel area 148 of door 108, as shown in FIG. 1. In such an embodiment, input/output ("I/O") signals may be routed between the control system and various operational components of dishwasher appliance 100 along wiring harnesses that may be routed through bottom 110 of door 108. Typically, controller 146 includes a user interface panel/controls 150 through which a user may select various operational features and modes and monitor progress of dishwasher appliance 100. In one embodiment, user interface 150 may represent a general purpose I/O ("GPIO") device or functional block. Additionally, user interface 150 may include input components, such as one or more of a variety of electrical, mechanical or electro-mechanical input devices including rotary dials, push buttons, and touch pads. User interface 150 may also include a display component, such as a digital or analog display device designed to provide operational feedback to a user. As is generally understood, user interface 150 may be in communication with controller 146 via one or more signal lines or shared communication busses.

It should be appreciated that the present subject matter is not limited to any particular style, model, or configuration of dishwasher appliance. The exemplary embodiment depicted in FIGS. 1 and 2 is simply provided for illustrative purposes only. For example, different locations may be provided for user interface 150, different configurations may be provided for racks 120 and 122, and other differences may be applied as well.

Figure 4:
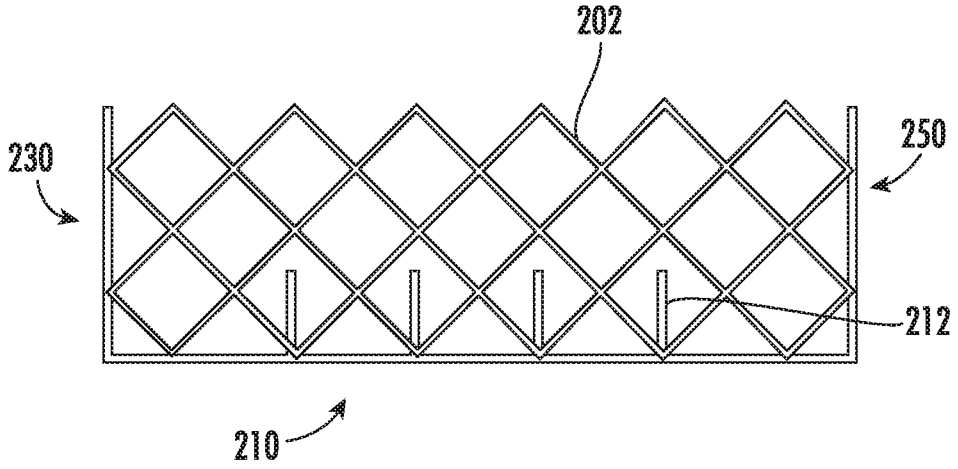
FIG. 4 provides a side section view of the wash rack of FIG. 3 in a completed position.
Figure 5:
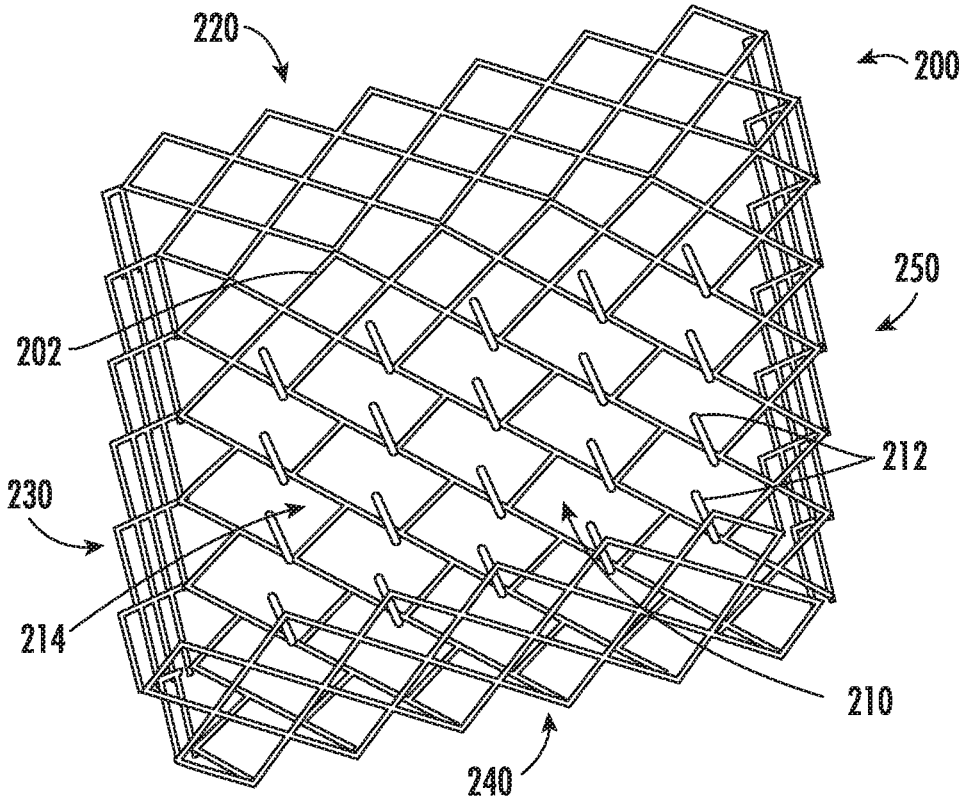
FIG. 5 provides a perspective view of the exemplary wash rack of FIG. 4.

FIGS. 3 through 5 illustrate a wash basket or rack 200 according to an exemplary embodiment. Wash rack 200 may be used in or with any suitable dishwasher appliance. For example, wash rack 200 may be used in dishwasher appliance 100 (FIG. 2) as one of rack assemblies 120 and 122. Thus, wash rack 200 is described below in the context of dishwasher appliance 100. Wash rack 200 defines a vertical direction V, a lateral direction L and a transverse direction T that are mutually perpendicular and form an orthogonal direction system. As discussed in greater detail below, wash rack 200 includes features for improving performance of dishwasher appliance 100 and/or cleaning of articles within wash rack 200.

As may be seen in FIG. 3, wash rack 200 may be formed from a single blank 300 of expanded metal. For example, a single sheet of suitable metal may be formed into the single blank 300 of expanded metal by passing through a die or series of dies. For the sake of brevity, a detailed description of the forming of expanded metal will be omitted.

Expanded metal blank 300 may include a plurality of strands 202 that provide structure to the blank 300. The strands 202 may be arranged to form a series of holes or apertures 204. The holes 204 may be any suitable shape. In other words, the die or series of dies used to form the blank 300 may have a variety of shapes to bend the strands 202 into various shapes. In one embodiment, the holes 204 are diamond shaped. According to this embodiment, each of the holes 204 may define a first axis 250 and a second axis 252 perpendicular to the first axis 250. The first axis 250 may be defined from a first junction between two intersecting strands 202 to a second junction between two intersecting strands 202 opposite the first junction. The second axis 252 may be defined from a third junction between two intersecting strands 202 to a fourth junction between two intersecting strands 202 opposite the third junction and may intersect the first axis 250 at a midpoint of the hole 204. The first axis 250 may be a long axis and the second axis 252 may be a short axis. The first axis 250 may be twice as long as the second axis 252.

The blank 300 may include a base 210 and a plurality of extensions or side panels 211. The base 210 may include a first edge 2101, a second edge 2102, a third, edge 2103, and a fourth edge 2104. The first edge 2101 and the third edge 2103 may be opposite each other and extend parallel to each other (e.g., in the lateral direction L). The second edge 2102 and the fourth edge 2104 may be opposite each other and extend parallel to each other (e.g., in the transverse direction). The plurality of extensions 211 may be formed during a process to be described below.

The plurality of extensions may include a first extension 220 extending in the lateral direction L along the first edge 2101 of the base 210 and in the vertical direction V from the first edge 2101 of the base 210, a second extension 230 extending in the transverse direction T along the second edge 2102 of the base 210 and in the vertical direction V from the second edge 2102 of the base 210, a third extension 240 extending in the lateral direction L along the third edge of the base 210 and in the vertical direction V from the third edge 2103 of the base 210, and a fourth extension 250 extending in the transverse direction T along the fourth edge of the base 210 and in the vertical direction V from the fourth edge 2104 of the base 210. The base 210 and the plurality of extensions 211 may define a basket volume 254.

Each of the extensions may include a first edge and a second edge. The first edge and the second edge of each of the extensions may extend in the vertical direction V. The first edge and the second edge may be opposite and/or parallel to each other (e.g., the first edge may define a first end of an extension, and the second edge may define a second end of the extension). As shown, a first edge 222 of the first extension 220 may be attached to a first edge 232 of the second extension 230 along the vertical direction V. The first edges 222 and 232 may be attached by any suitable manner, for example, a clip, a tie, a braze, a spot weld, or an adhesive. When assembled, the first edges 222 and 232 create a seam that runs in the vertical direction V from a corner of the base 210. In more detail, the first edges 222 and 232 may each be defined by point contacts at junctions of intersecting strands 202. For example, in the exemplary embodiment of FIG. 5, the first edges 222 and 232 each define two connection points along the vertical seam. Each connection point may be a junction of intersecting strands. The first edges 222 and 232 may be attached at the connection points.

A second edge 234 of the second extension 230 may be attached to a first edge 242 of the third extension 240 along a vertical direction V. The second edge 234 and the first edge 242 may be attached by any suitable manner, for example, a clip, a tie, a braze, a spot weld, or an adhesive. The second edge 234 and the first edge 242 may create a seam that runs in the vertical direction V from a corner of the base 210. In more detail, the second edge 234 and the first edge 242 may each be defined by point contacts at junctions of intersecting strands 202. For example, referring to FIG. 5, the second edge 234 and the first edge 242 each define two connection points along the vertical seam. Each connection point may be a junction of intersecting strands. The second edge 234 and the first edge 242 may be attached at the connection points.

A second edge 244 of the third extension 240 may be attached to a first edge 252 of the fourth extension 250 along a vertical direction V. The second edge 244 and the first edge 252 may be attached by any suitable manner, for example, a clip, a tie, a braze, a spot weld, or an adhesive. The second edge 244 and the first edge 252 may create a seam that runs in the vertical direction V from a corner of the base 210. In more detail, the second edge 244 and the first edge 252 may each be defined by point contacts at junctions of intersecting strands 202. For example, referring to FIG. 5, the first edge 252 and the second edge 244 each define two connection points along the vertical seam. Each connection point may be a junction of intersecting strands. The second edge 244 and the first edge 252 may be attached at the connection points.

A second edge 254 of the fourth extension 250 may be attached to a second edge 224 of the first extension 220 along a vertical direction V. The second edges 224 and 254 may be attached by any suitable manner, for example, a clip, a tie, a braze, a spot weld, or an adhesive. The second edges 224 and 254 may create a seam that runs in the vertical direction V from a corner of the base 210. In more detail, the second edges 224 and 254 may each be defined by point contacts at junctions of intersecting strands 202. For example, referring to FIG. 5, the second edges 224 and 254 each define two connection points along the vertical seam. Each connection point may be a junction of intersecting strands. The second edges 224 and 254 may be attached at the connection points.

The base 210 may include a plurality of tines 212. Each of the plurality of tines 212 may extend generally in the vertical direction V from the base 210. In more detail, each of the plurality of tines 212 may be formed from a strand 202 of the base. For example, alternating strands 202 of the base 210 are cut at a junction of intersecting strands 202 and bent to a predetermined angle with respect to the base 210. The predetermined angle may be between 60 degrees and 90 degrees with respect to the base 210 (e.g., a direction or plane perpendicular to the vertical direction V). In one example, the tines 212 are bent to 90 degrees with respect to the base 210 (e.g., the tines extend in the vertical direction V). Each of the plurality of tines 212 may be integral with the base 210. Any suitable number of tines 212 may be formed. For example, in the exemplary embodiment of FIG. 5, twenty tines 212 are formed. Nonetheless, it should be noted that the number of tines may be increased or decreased depending on a specific application, and the disclosure is not limited to the amount shown and described herein.

The tines 212 may extend to a predetermined length from the base 210 (e.g., along the vertical direction V). The length of the tines 212 may de dependent on a size of the holes 204 formed in the base 210. For example, the length of a tine 212 may be a length of a strand 202 defined between a first junction and a second junction of intersecting strands 202.

Specifically, the tines 212 may be between three to five inches long. In one example, the tines 212 are four inches long. The tines 212 may also have a predetermined thickness. The thickness of the tines 212 may be commensurate with a thickness of the strands 202. The thickness of the tines 212 may be determined during a forming process of the blank 300. The thickness of the tines 212 may be between 0.06 inches and 0.12 inches. In one example, a thickness of the tines 212 is 0.1 inches.

The wash rack 200 may include a waterproof coating 214. For instance, the base 210, the plurality of extensions 211, and the tines 212 may be coated with a waterproof coating 214 during assembly. The waterproof coating 214 may be a liquid or spray-on coating. The waterproof coating 214 may be applied by dipping the wash rack 200 in a liquid vat. The waterproof coating 214 may be a rubber or polyvinyl coating. However, the disclosure is not limited to these examples, and any coating capable of resisting water may be used.

Advantageously, a dishwasher or wash rack in accordance with the present disclosure or methods may be constructed in a relatively fast, low-cost, or efficient manner. Additionally or alternatively, a wash rack in accordance with the present disclosure or methods may reduce an amount of raw materials used and waste product created. Additionally or alternatively, a wash rack in accordance with the present disclosure or methods may reduce cost and maintenance of equipment used in manufacturing.

Figure 6:
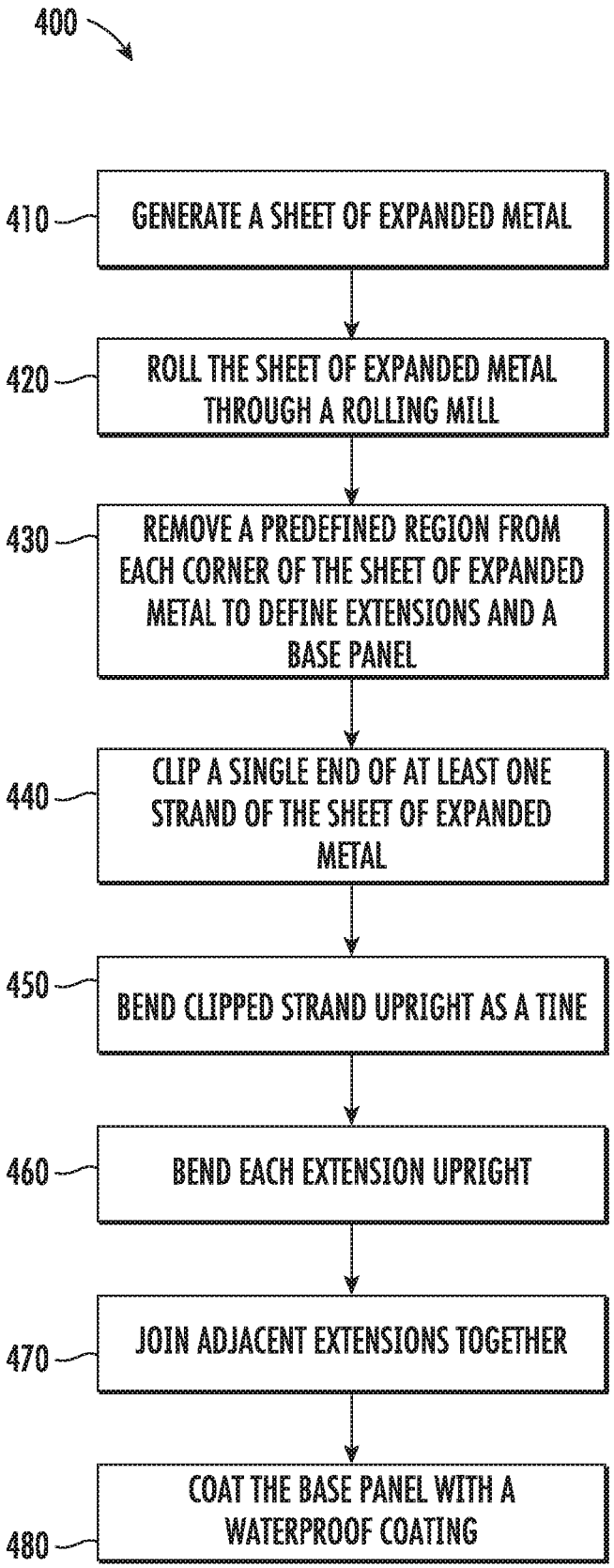
FIG. 6 provides a flow chart illustrating a method of forming a wash rack according to exemplary embodiments of the present disclosure.

Referring now to FIG. 6, a method 400 of forming a wash rack (e.g., wash rack 200) will be described in detail. At 410, the method 400 includes generating a sheet of expanded metal. For instance, a sheet of metal may be fed into a die to form the sheet or blank of expanded metal, as would be understood. The die may have any suitable shape in order to create the sheet of expanded metal. The sheet of expanded metal may have varying dimensions in order to be accommodated within various dishwashers. For example, the sheet of expanded metal may be square.

At 420, the method 400 includes rolling the sheet of expanded metal through a rolling mill. The sheet of expanded metal may be fed through a rolling mill to flatten the strands and remove sharp edges or burrs that are present on the strands. The rolling mill may be configured to produce strands having a predetermined thickness.

At 430, the method 400 includes removing a predefined region from each corner of the sheet of expanded metal. A process may be performed to cut or remove the corners of the sheet of expanded metal in order to form the plurality of extensions. For example, a square region is cut from each corner of the sheet of expanded metal. The base panel may be formed at a central region of the sheet of expanded metal. Each extension of the plurality of extensions may extend from an edge of the base panel. In one example, the base panel is a square, and four extensions are formed (e.g., in the shape of a cross or "+"). Each of the extensions may extend according to a predetermined length from the base panel. In some such embodiments, the predetermined length for each of the extensions is equal or the same. In alternate embodiments, one or more of the plurality of extensions extends according to a different predetermined length from the base panel than one or more of the remaining plurality of extensions. For example, three of the extensions may extend to a first predetermined length from the base panel, while the fourth extension extends to a second predetermined length from the base panel (e.g., shorter than the first predetermined length).

Each of the plurality of extensions may have a similar shape. In one embodiment, each of the plurality of extensions is predominantly rectangular. In an alternate embodiment, one ore more of the plurality of extensions may have a different shape. Generally, any suitable cutting operation may be used to cut the sheet of expanded metal and define the extensions, such as a cutting press, mill, shear set, etc.

At 440, the method 400 includes clipping a single end of a strand of the plurality of strands. Prior to the clipping, the strand may be part of the base panel. Following the clipping, the strand generally remains attached to the base, but only at the unclipped, integral end. Optionally, multiple strands of the plurality of strands may be clipped. The strand or strands may be clipped at a first end of the strand. The first end of the strand may be located at a first junction of two intersecting strands. The clipped strands may be parallel to each other along the base panel. Alternatively, the clipped strands may not be parallel to each other. For example, a first strand extending in a first horizontal direction (e.g., at a first angle with respect to the lateral direction L) may be cut, and a second strand extending in a second horizontal direction (e.g., at a second angle with respect to the lateral direction L) may also be cut. According to this example, the first strand and the second strand are not adjacent to each other in order to preserve structural integrity of the base. The clipped strands may be spaced apart from each other along the base panel. For example, the clipped strands may be equidistant from each other along the base panel (e.g., along a direction perpendicular to the vertical direction V). In an additional or alternative embodiment, the clipped strand may be part of one or more of the extensions.

At 450, the method 400 includes bending the clipped strand upright. The clipped strand may be formed into a tine that extends from the base panel. The strand or strands may be bent at a second end of the strand. The second end of the strand may be opposite the first end of the strand. For example, the second end of the strand may be located at a second junction of two intersecting strands of the base panel. The second junction may be opposite the first junction along the clipped strand. In other words, the strand may be clipped at the first junction and bent at the second junction. Any suitable method may be used to bend the strand. For example, a press or die may be used to bend the strand.

The tine may extend in the vertical direction V from the base panel. In some embodiments, the tine extends at a predetermined angle with respect to the base panel. As mentioned previously, multiple strands may be bent to form multiple tines. Each of the tines may extend to the same predetermined angle with respect to the base panel. In other words, each of the tines may be parallel to each other. In other embodiments, each of the tines may extend to different angles with respect to the base panel.

In some embodiments, a second or third bend is further applied to the strand or strands. For example, a first bend may be applied to the second unclipped end such that a first portion of the tine extends in the vertical direction V. A predetermined distance up the tine (e.g., 1 inch), a second bend may be applied to the tine such that a second portion of the tine above the first portion extends at a predetermined angle with respect to the first portion of the tine. Another predetermined distance up the tine (e.g., 1 inch), a third bend may be applied to the tine such that a third portion of the tine above the second portion extends in the vertical direction V, parallel to the first portion of the tine.

At 460, the method 400 includes bending each extension of the plurality of extensions upright with respect to the base panel. Each of the plurality of extensions may be bent in the vertical direction V from a junction of each of the extensions to the base panel. Each extension may be bent to be perpendicular to the base panel. In other words, each extension may form a 90-degree angle with the base panel. In some embodiments, one or more of the extensions may form a different angle with respect to the base panel. An extension may also include two or more bends. In other words, a first section of the extension may be bent to a first angle with respect to the base panel, and a second section may be bent to a second angle with respect to the first section. In some embodiments, the second section is perpendicular to the base panel. It should be appreciated that each of the extensions may be bent any suitable number of times and may form any suitable angle with respect to the base panel such that the enclosed volume of the basket is generally to hold articles therein.

At 470, the method 400 includes joining adjacent extensions of the plurality of extensions to fix or maintain the basket volume with the base panel of the sheet of expanded metal. For example, as described above, a first edge of an extension may be attached to a first edge of an adjacent extension along a vertical direction V. The first edges may be attached by any suitable manner, for example, a clip, a tie, a braze, a spot weld, or an adhesive. The first edges may create a seam that runs in the vertical direction V from a corner of the base. In more detail, the first edges may each be defined by point contacts at junctions of intersecting strands. For example, the first edges may each define two or more connection points along the vertical seam. Each connection point may be a junction of intersecting strands. In some such embodiments, 470 includes attaching one or more connection points of one first edge to one or more corresponding connection points of another first edge.

At 480, the method 400 includes coating the base panel with a waterproof coating. In some embodiments, the entire wash rack is coated with the waterproof coating. For instance, the base, the plurality of extensions, and the tines may be coated with a waterproof coating. The waterproof coating may be a liquid or spray-on coating. For instance, the coating may be applied by dipping the wash rack in a liquid vat. Optionally, the waterproof coating may be a rubber or polyvinyl coating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction that are mutually perpendicular, the dishwasher comprising:

a tub defining a wash chamber;

a spray body positioned within the wash chamber of the tub; and a wash rack positioned within the wash chamber of the tub above the spray body along the vertical direction, the wash rack comprising an expanded metal basket comprising a base panel and a plurality of side panels extending upwardly from the base panel, the expanded metal basket defining a basket volume, the base panel comprising a plurality of strands, wherein the base panel and the plurality of side panels are expanded from a single metal piece; and a plurality of tines extending from the base panel, each of the plurality of tines being integral with the base panel, wherein each of the plurality of tines comprises a first end clipped from the base panel and a second end opposite the first end, the second end being bent at a junction of the plurality of strands, and wherein the plurality of strands defines a plurality of diamond shaped apertures in the base panel, and wherein each diamond shaped aperture of the plurality of diamond shaped apertures defines a short axis and a long axis perpendicular to the short axis.

2. The rack of claim 1, wherein the long axis is twice as long as the short axis.

3. The rack of claim 1, wherein the base panel extends in the lateral direction and the transverse direction, and each side panel of the plurality of side panels is bent in the vertical direction from edges of the base panel.

4. The rack of claim 3, wherein the plurality of side panels comprises four side panels, and wherein each side panel extends in the vertical direction from a respective edge of the base panel.

5. The rack of claim 4, wherein a first edge of a first side panel is attached to a first edge of a second side panel along the vertical direction, wherein a second edge of the second side panel is attached to a first edge of a third side panel along the vertical direction, wherein a second edge of the third side panel is attached to a first edge of a fourth side panel along the vertical direction, and wherein a second edge of the fourth side panel is attached to a second edge of the first side panel along the vertical direction.

6. The rack of claim 1, wherein the expanded metal basket further comprises a waterproof coating layer coating the base panel.

7. The rack of claim 1, wherein each of the plurality of tines is bent to a predetermined angle with respect to the base panel.

8. The rack of claim 1, wherein a thickness of the plurality of strands is between 0.08 inches and 0.12 inches.

9. A method of forming a dishwasher rack defining a vertical direction, a lateral direction, and a transverse direction, the method comprising:

generating a single sheet of expanded metal having a plurality of strands;

rolling the sheet of expanded metal through a rolling mill;

removing a predefined region from each corner of a plurality of corners of the sheet of expanded metal to form a plurality of extensions extending from a base panel of the sheet of expanded metal;

clipping a single end of a strand of the plurality of strands, the clipped end being opposite of an unclipped end;

bending the clipped strand upright as a tine with respect to the unclipped end, wherein the tine is integral with the base panel;

bending each extension of the plurality of extensions upright with respect to the base panel; and joining adjacent extensions of the plurality of extensions to define a basket volume together with the base panel of the sheet of expanded metal, wherein the base panel and the plurality of extensions are expanded from the single sheet of expanded metal, and wherein the plurality of strands defines a plurality of diamond shaped apertures in the base panel, and wherein each diamond shaped aperture of the plurality of diamond shaped apertures defines a short axis and a long axis perpendicular to the short axis.

10. The method of claim 9, wherein the long axis is twice as long as the short axis.

11. The method of claim 9, wherein the base panel extends in the lateral direction and the transverse direction, and each extension of the plurality of extensions is bent in the vertical direction from edges of the base panel.

12. The method of claim 9, wherein the joining adjacent extensions of the plurality of extensions comprises:

attaching a first edge of a first extension to a first edge of a second extension;

attaching a second edge of the second extension to a first edge of a third extension;

attaching a second edge of the third extension to a first edge of a fourth extension; and attaching a second edge of the fourth extension to a second edge of the first extension.

13. The method of claim 12, wherein the extensions are attached to each other along the vertical direction.

14. The method of claim 9, further comprising coating the base panel with a waterproof coating layer.

15. The method of claim 9, wherein the tine comprises a plurality of tines, and wherein each tine of the plurality of tines is bent to a predetermined angle with respect to the base panel.

16. The method of claim 9, wherein a thickness of the plurality of strands is between 0.08 inches and 0.1 inches.

17. The method of claim 9, wherein a length of each of the plurality of tines is four inches.

18. The rack of claim 5, wherein the first panel is attached to the second panel with no overlaps, the second panel is attached to the third panel with no overlaps, the third panel is attached to the fourth panel with no overlaps, and the fourth panel is attached to the first panel with no overlaps.

* * * * *